US009358665B2

(12) United States Patent
Talbot et al.

(10) Patent No.: US 9,358,665 B2
(45) Date of Patent: Jun. 7, 2016

(54) HAND SANDER THAT IS SELECTIVELY ATTACHABLE TO A DUST-VACUUM SYSTEM

(71) Applicants: Corey Talbot, Hebron, CT (US); Richard M. Farland, Fiskdale, MA (US); Romeo Arvinte, Laval (CA)

(72) Inventors: Corey Talbot, Hebron, CT (US); Richard M. Farland, Fiskdale, MA (US); Romeo Arvinte, Laval (CA)

(73) Assignee: HYDE TOOLS, INC., Southbridge, MA (US)

( * ) Notice: Subject to any disclaimer, the term of this patent is extended or adjusted under 35 U.S.C. 154(b) by 127 days.

(21) Appl. No.: 13/866,318

(22) Filed: Apr. 19, 2013

(65) Prior Publication Data

US 2013/0309948 A1 Nov. 21, 2013

Related U.S. Application Data

(63) Continuation-in-part of application No. 29/422,217, filed on May 17, 2012, now Pat. No. Des. 720,592.

(60) Provisional application No. 61/671,071, filed on Jul. 12, 2012.

(30) Foreign Application Priority Data

Nov. 30, 2011 (CA) ..... 143477
Mar. 21, 2012 (CA) ..... 144980

(51) Int. Cl.

| | |
|---|---|
| ***B24B 55/10*** | (2006.01) |
| ***B24D 15/02*** | (2006.01) |
| ***B24D 15/04*** | (2006.01) |
| *B24B 7/18* | (2006.01) |

(52) U.S. Cl.

CPC ..... *B24B 55/10* (2013.01); *B24D 15/023* (2013.01); *B24D 15/04* (2013.01); *B24B 7/184* (2013.01)

(58) Field of Classification Search

CPC ..... B24B 7/182; B24B 7/184; B24B 55/10; B24D 15/00; B24D 15/04; B24D 15/023
USPC ..... 451/354, 456, 523, 524, 525
See application file for complete search history.

(56) References Cited

U.S. PATENT DOCUMENTS

| | | | |
|---|---|---|---|
| 3,256,648 | A | 6/1966 | Subonovich |
| 3,826,045 | A | 7/1974 | Champayne |
| 3,862,521 | A | 1/1975 | Isaksson |
| 4,071,981 | A | 2/1978 | Champayne |

(Continued)

*Primary Examiner* — Timothy V Eley
(74) *Attorney, Agent, or Firm* — Louis J. Franco; Law Office of Louis J. Franco

(57) ABSTRACT

A sponge sander configured for selective attachment to a dust-collection system includes a housing having a housing-interior surface defining a sponge cavity and a sponge seat configured for removably retaining a determinately-dimensioned sanding sponge. The sponge has an abrasive sanding surface, a back surface opposite the sanding surface and a sponge periphery defined between the sanding and back surfaces. The sponge is retained within the sponge cavity such that (i) the abrasive sanding surface can engage a work surface to be sanded, (ii) fluid-flow channels are maintained between the sanding sponge and the housing-interior surface and (iii) the spaces are in fluid communication with a fluid port defined in the housing so that when a negative pressure is applied across the fluid port by a vacuum system external to the housing, dust created by sanding is drawn into the fluid-flow channels and out of the housing through the fluid port.

9 Claims, 3 Drawing Sheets

(56) References Cited

U.S. PATENT DOCUMENTS

| | | | | |
|---|---|---|---|---|
| 4,135,334 | A | 1/1979 | Rudiger | |
| 4,598,500 | A | 7/1986 | Faraudo | |
| 4,680,895 | A | 7/1987 | Roestenberg | |
| 4,697,389 | A | 10/1987 | Romine | |
| 4,937,984 | A | 7/1990 | Taranto | |
| D344,003 | S * | 2/1994 | Milkie | D8/90 |
| 5,470,272 | A | 11/1995 | Kikuchi | |
| 5,540,616 | A * | 7/1996 | Thayer | 451/354 |
| 6,988,940 | B1 | 1/2006 | Taylor | |
| 7,033,259 | B1 | 4/2006 | Seasholtz | |
| 7,364,500 | B2 * | 4/2008 | Brown | 451/523 |
| 8,684,792 | B2 * | 4/2014 | Rocha | 451/28 |

* cited by examiner

HAND SANDER THAT IS SELECTIVELY ATTACHABLE TO A DUST-VACUUM SYSTEM

Priority based on U.S. Provisional Application Ser. No. 61/671,071 filed Jul. 12, 2012, and entitled "SPONGE SANDER THAT IS SELECTIVELY ATTACHABLE TO A DUST-VACUUM SYSTEM" is claimed. Additionally, the present Application is a continuation-in-part of co-pending U.S. Design patent application Ser. No. 29/422,217 filed May 17, 2012 under the title "HAND SANDER." U.S. Design application Ser. No. 29/422,217 in turn claimed foreign priority benefits in Canadian Industrial Design Application No. 143477 filed Nov. 30, 2011 under the title "DUST FREE HAND SANDER" and Canadian Industrial Design Application No. 144980 filed Mar. 21, 2012 under the title "HAND SANDER." The present application accordingly claims priority in the aforesaid Canadian applications through U.S. Design Application No. 29/422,217.

BACKGROUND

For centuries, dry sanding tools have been developed and used to smooth and finish surfaces such as plaster, clay, metal, drywall and wood. Coated abrasives such as sandpaper date to at least as early as 13$^{th}$-Century China. An undesirable consequence of dry sanding is the creation of dust that is both messy and potentially dangerous to inhale.

One method of reducing sanding dust is "wet sanding." In wet sanding, the sanding implement (e.g., sanding sponge or sandpaper) and/or the surface being sanded is made wet or damp with water or a liquid solution. However, wet sanding is generally more time consuming, presents its own inconveniences and hazards, and is inappropriate for some situations and surfaces.

Accordingly, a need exists for sanding apparatus that facilitate the convenient removal and centralized collection of dust created during dry sanding.

SUMMARY

In an illustrative embodiment, a hand sander configured for selective attachment to a dust-collection system includes a housing having at least one wall defining a housing interior surface, a sponge cavity and a recessed sponge seat configured for removably receiving and retaining a determinately-dimensioned sanding sponge. The sanding sponge has an abrasive sanding surface, a back surface opposite the sanding surface and at least one side surface extending between the sanding and back surfaces and defining a sponge periphery. The housing further defines a fluid port through which a fluid can pass from the sponge cavity to the exterior of the housing and a sponge opening through which the sanding sponge is alternatively introduced into and removed from the sponge cavity.

In each of various versions, the sponge seat is defined by a plurality of sponge-seating protrusions that depend from the housing-interior surface and extend into the sponge cavity. The protrusions are configured to contactably engage and support at least one of the sponge periphery and the back surface of the sanding sponge such that, when the sponge is retained within the sponge cavity, (i) the abrasive sanding surface can engage a work surface to be sanded, (ii) spaces are maintained between the sanding sponge and the housing-interior surface and (iii) the spaces are in fluid communication with the fluid port. The spaces act as fluid-flow channels such that application of negative pressure (e.g., suction from a vacuum system) through the fluid port draws sanding dust created by engagement of the sanding surface with the work surface into the fluid-flow channels and out of the housing through the fluid port.

Although the particular predetermined geometry of the sanding sponge is not of any particular importance, the sponge cavity and sponge-seating protrusions of various alternative embodiments are configured for receiving and retaining sanding sponges of at least one of rectangular, triangular, circular and elliptical periphery. Included within these illustrative shapes, are sponges having peripheries that are generally or substantially one of these shapes, even if they do not meet a strict geometrical definition as rectangular, triangular, circular or elliptical. For example, a sponge that has rounded corners, but otherwise suggests a rectangle or triangle is within the scope of "rectangular" or "triangular" as defined in this description and the claims appended hereto. Moreover, as is already understood as a matter of mathematical fact, a square is a special case of a rectangular and is therefore within the meaning of rectangle.

Additionally envisioned within the scope of the invention as defined in the claims are embodiments configured for accepting conventionally sized and configured sanding sponges that are already widely available. Such embodiments require no specialized sponge shape, such as, by way of example, sponges with undulated peripheries that serve to define fluid-flow spaces between the sponge and housing-interior surface. More specifically, various such embodiments accommodate sponges having peripheries defined by planar or "smoothly curved" side surfaces.

The manner of retaining sponges within the sponge cavity might also vary among embodiments, but as with sponge geometry, sponge-retention mechanisms are not central to the overall inventive aspects. In various versions, a sponge is retained by its being slightly compressed to fit within the sponge cavity. In such instances, friction between the sponge periphery and the peripherally-disposed protrusions extending into the sponge cavity retains a sponge. In alternative embodiments, selectively releasable mechanisms such as adhesive, hook-and-loop fasteners or magnetism might be employed, by way of non-limiting example.

Representative embodiments are more completely described and depicted in the following detailed description and the accompanying drawings.

DETAILED DESCRIPTION

The following description of variously embodied hand sanders is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
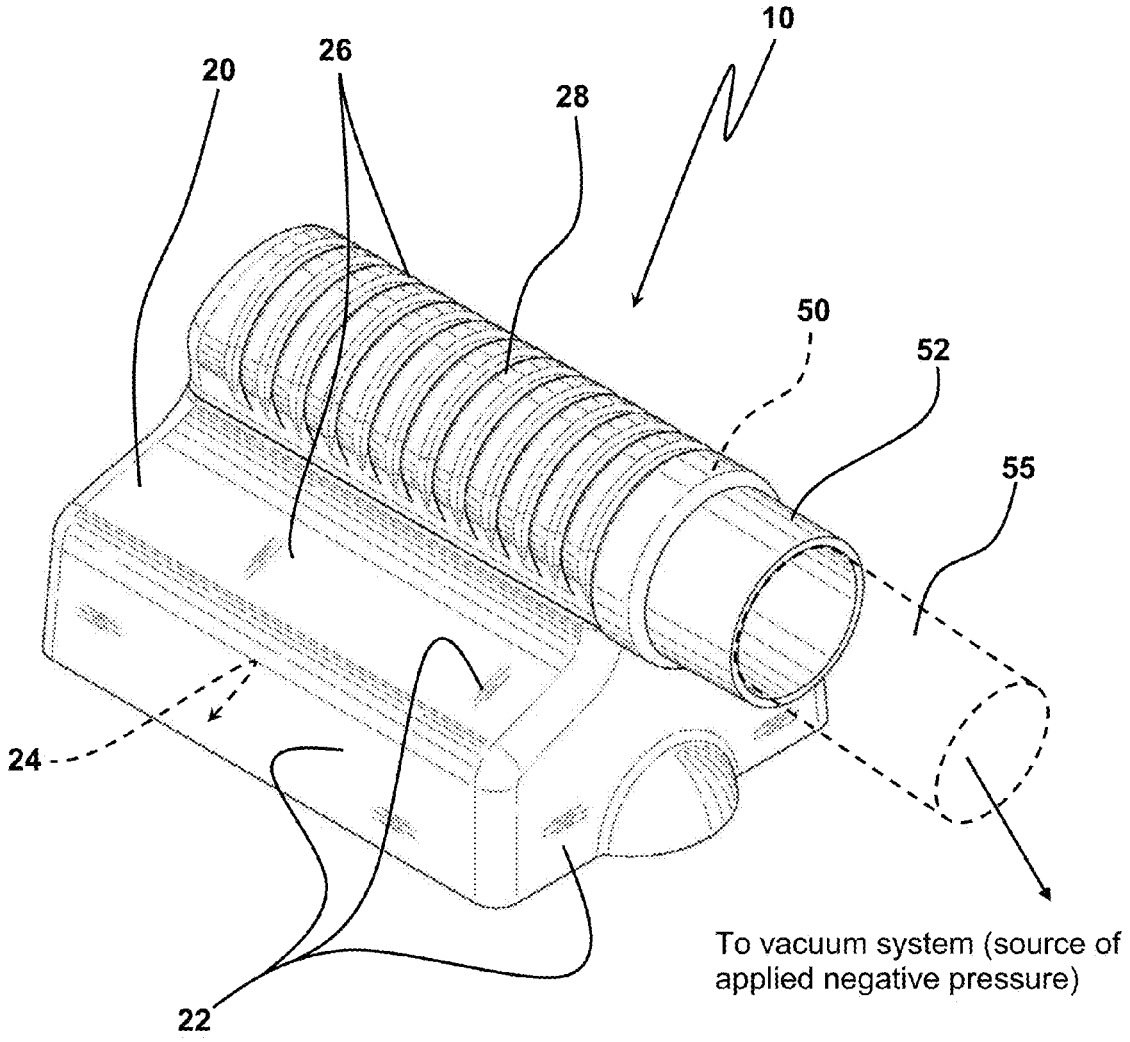
FIG. 1 is a left and rear side view of a hand sander configured for retention of a sanding sponge and selective attachment to a dust-collection system.
Figure 2:
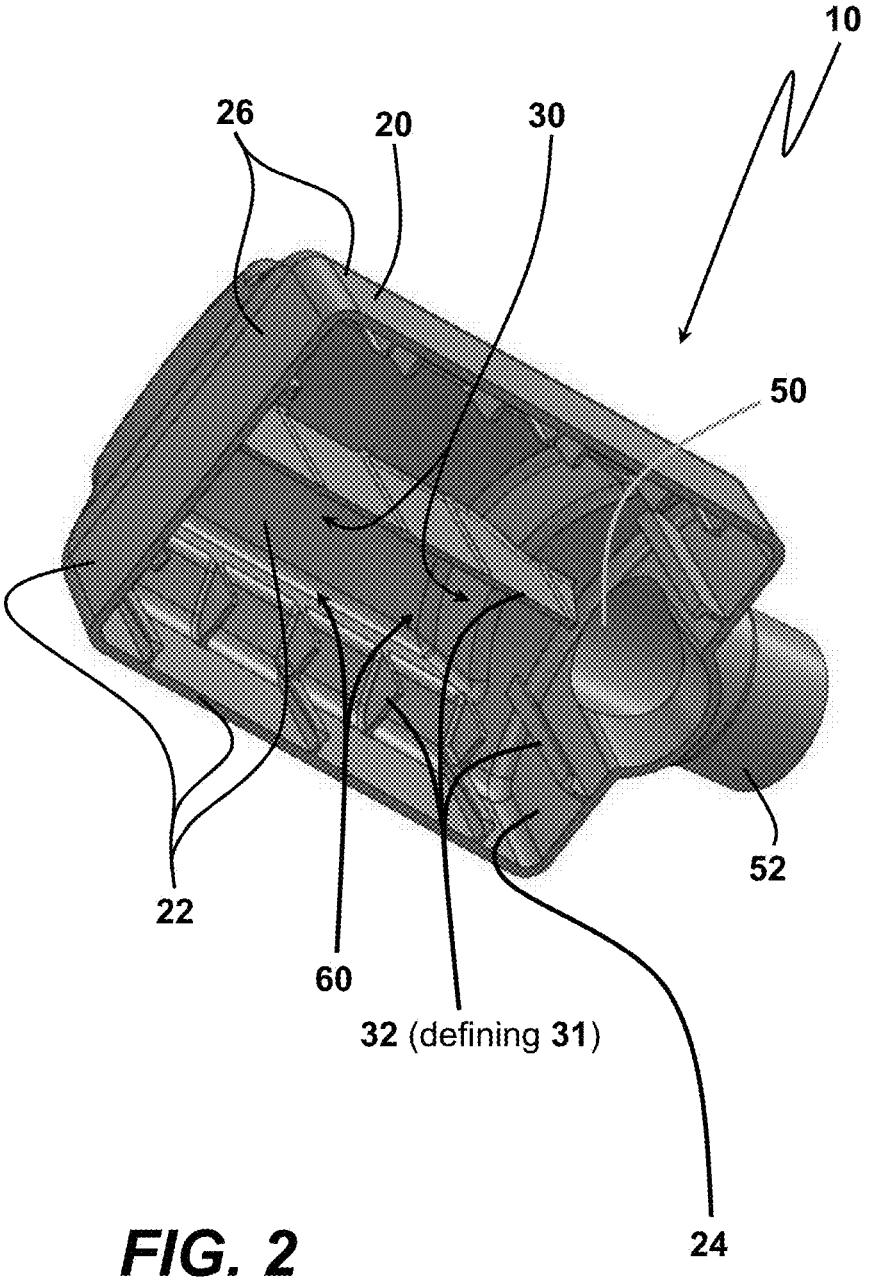
FIG. 2 is a bottom view of a hand-held sponge sander.
Figure 3:
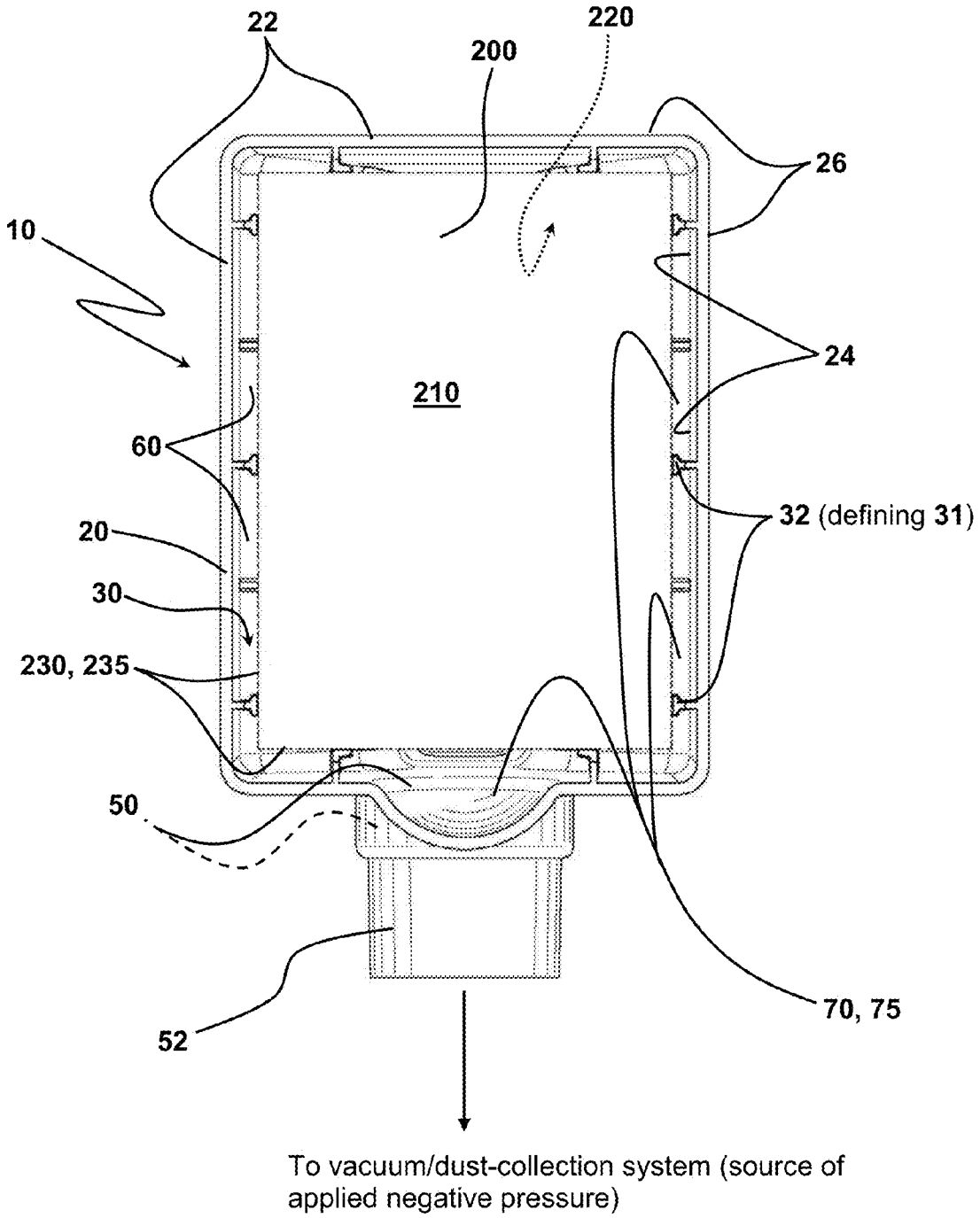
FIG. 3 is a bottom view of a hand-held sponge sander retaining and supporting a sanding sponge.

Referring initially to FIGS. 1 and 2, an illustrative hand sander 10 is configured for selective attachment to a dust-collection system such as a dust-vacuum (not shown). The hand sander 10 includes a housing 20 having at least one wall 22 defining a housing-interior surface 24 and a housing-exterior surface 26. The housing-interior surface 24 defines a sponge cavity 30 with a recessed sponge seat 31 defined by sponge-seating protrusions 32 configured for retaining and supporting a sanding sponge as shown in FIG. 3. At least a portion of the housing-exterior surface 26 is configured to serve as a handle 28 suitable for grasping by a user's hand.

As shown most clearly in FIG. 2, the housing 20 further defines a fluid port 50 through which a fluid (e.g., air) can pass, through a fluid conduit 52, from the sponge cavity 30 to the exterior of the housing 20. In the particular versions depicted in FIGS. 1 and 2, the fluid conduit 52 is integrally formed with the housing 20 and thus forms a part of the housing 20. However, versions in which the fluid port 50 is a simple opening in at least one housing wall 22 configured to couple with a non-integral conduit are expressly within the scope and contemplation of the invention.

With continued reference to FIG. 2, and additional reference to FIG. 3, the sponge cavity 30 is configured to retain a sanding sponge 200 of predetermined dimensions having a front abrasive sanding surface 210, a back surface 220 opposite the sanding surface 210 and at least one side surface 230 extending between the sanding and back surfaces 210 and 220 to define a sponge periphery 235. The sanding surface 210 of a retained sanding sponge 200 is exposed to the exterior of the housing 20 through a sponge opening 60 for selective engagement of a work surface to be sanded. In embodiments in which the sanding sponge 200 is replaceable, the sponge opening 60 also facilitates removal from and insertion into the sponge cavity 30 of sanding sponges 200.

Referring still to FIGS. 2 and 3, the sponge-seating protrusions 32 depend from and extend inwardly into the sponge cavity 30 from the housing-interior surface 24. The sponge-seating protrusions 32 are individually configured, and mutually arranged, to support by contactable engagement at least one of the sponge periphery 235 and the back surface 220 of the retained sanding sponge 200 such that spaces 70 are defined and maintained between the sanding sponge 200 and the housing-interior surface 24. The defined spaces 70 serve as fluid-flow channels 75 and are in fluid communication with the fluid port 50. More specifically, the channels 75 and fluid port 50 are configured such that a negative pressure applied through the fluid port 50 draws sanding dust created by engagement of the sanding surface 210 with a work surface (not shown) into the spaces 70 and out of the housing 20 through the fluid port 50. In association with various embodiments, the negative pressure is applied through the fluid port 50 by a dust-vacuum system (not shown) coupled in fluid communication with the fluid port 50. In the specific example of FIGS. 1-3, the fluid conduit 52 integrally formed with the housing 20 is selectively coupleable to a non-integral secondary conduit 55 for establishing fluid communication between the fluid port 50 the dust-vacuum system.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact construction, implementations and versions shown and described.

What is claimed is:

1. A hand sander configured for selective attachment to a dust-collection system and comprising:

a housing having at least one wall defining a housing-interior surface, a sponge cavity and a recessed sponge seat configured for removably receiving and retaining a determinately-dimensioned sanding sponge with an abrasive sanding surface, a back surface opposite the sanding surface and at least one side surface extending between the sanding and back surfaces and defining a sponge periphery, the housing further defining a fluid port through which a fluid can pass from the sponge cavity to the exterior of the housing and a sponge opening through which the sanding sponge is alternatively introduced into and removed from the sponge cavity; and a plurality of sponge-seating protrusions extending into the sponge cavity from the housing-interior surface and configured to contactably engage the sponge periphery and the back surface of the sanding sponge such that, when the sponge is retained within the sponge cavity, (i) the abrasive sanding surface can engage a work surface to be sanded, (ii) spaces are maintained between the sanding sponge and the housing-interior surface and (iii) the spaces are in fluid communication with the fluid port.

2. The sponge sander of claim 1 wherein the housing includes an exterior surface configured for grasping by a user's hand.

3. The sponge sander of claim 2 wherein the sponge cavity and recessed sponge seat are configured for receiving and retaining a sanding sponge having a periphery that is one of (i) rectangular, triangular, (iii) circular and (iv) elliptical.

4. A sponge sander configured for selective attachment to a dust-vacuum system and comprising:

a sanding sponge of predetermined geometric dimensions having an abrasive sanding surface, a back surface opposite the sanding surface and at least one side surface extending between the sanding and back surfaces to define a sponge periphery;

a housing having at least one wall defining a housing-interior surface and a sponge cavity configured for retaining the sanding sponge, the housing further defining a fluid port through which a fluid can pass from the sponge cavity to the exterior of the housing and a sponge opening through which the sanding surface of the retained sponge is exposed to the exterior of the housing for selective engagement of a work surface to be sanded; and a plurality of sponge-seating protrusions extending into the sponge cavity from the housing-interior surface and configured to support within the sponge cavity the sponge periphery and the back surface of the sanding sponge such that (i) fluid-flow channels in fluid communication with the fluid port are defined between the sanding sponge and the housing-interior surface and (ii) a negative pressure applied through the fluid port draws sanding dust created by engagement of the sanding surface with the work surface into the fluid-flow channels and out of the housing through the fluid port.

5. The sponge sander of claim 4 further comprising a fluid conduit that is integrally formed with the housing and selectively coupleable to a non-integral secondary conduit for establishing fluid communication between the fluid port and a vacuum system that selectively applies the negative pressure through the fluid port.

6. The sponge sander of claim 5 wherein the housing includes an exterior surface configured for grasping by a user's hand.

7. The sponge sander of claim 4 wherein the housing includes an exterior surface configured for grasping by a user's hand.

8. The sponge sander of claim 4 wherein the sponge is removably retained within the sponge cavity by the sponge-seating protrusions in order to enable sponge replacement.

9. The sponge sander of claim 8 wherein the sponge cavity and sponge-seating protrusions are configured for receiving and retaining a sanding sponge with a periphery that is one of (i) rectangular, (ii) triangular, (iii) circular and (iv) elliptical.

* * * * *